US007029088B2

(12) United States Patent
Fernandez

(10) Patent No.: US 7,029,088 B2
(45) Date of Patent: Apr. 18, 2006

(54) INK/TONER CARTRIDGE COMPENSATION FOR UNEVEN INK/TONER USAGE

(75) Inventor: Charles V. Fernandez, Eugene, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 197 days.

(21) Appl. No.: 10/681,848

(22) Filed: Oct. 8, 2003

(65) Prior Publication Data

US 2005/0078130 A1 Apr. 14, 2005

(51) Int. Cl.
*B41J 29/393* (2006.01)

(52) U.S. Cl. ..... 347/19

(58) Field of Classification Search ..... 347/2, 347/14, 19, 43, 86, 87, 115, 151
See application file for complete search history.

(56) References Cited

U.S. PATENT DOCUMENTS

| | | | | |
|---|---|---|---|---|
| 5,835,817 | A | 11/1998 | Bullock et al. | |
| 6,039,430 | A | 3/2000 | Helterline et al. | |
| 6,045,206 | A | 4/2000 | Igval | |
| 6,065,824 | A | 5/2000 | Bullock et al. | |
| 6,196,663 | B1 * | 3/2001 | Wetchler et al. | 347/43 |
| 6,454,381 | B1 | 9/2002 | Olsen et al. | |
| 6,494,553 | B1 | 12/2002 | Donahue et al. | |

* cited by examiner

*Primary Examiner*—Anh T. N. Vo

(57) ABSTRACT

This invention relates to a method and apparatus for use in ink/toner cartridge compensation in an attempt to better balance the ink/toner usage of the cartridge.

12 Claims, 5 Drawing Sheets

INK/TONER CARTRIDGE COMPENSATION FOR UNEVEN INK/TONER USAGE

BACKGROUND OF THE INVENTION

1. Field of the Invention

This invention relates to a method and apparatus for use in ink/toner cartridge compensation in an attempt to better balance the ink/toner usage of the cartridge.

2. Description of the Related Art

Prior to the present invention, as set forth in general terms above and more specifically below, it is known, to employ ink level sensing for inkjet printers. Exemplary prior art utilizes ink drop counting to measure the ink level of the cartridge. However, there is no determination of which ink color was depleted first, if a multi-color ink cartridge is used. Consequently, a more advantageous system, then, would be provided if such a determination of which ink/toner color was completed first could be made.

It is also known, in the replaceable ink container art, to employ a memory chip that is associated with the ink container. Until now, these memory chips were used to store operating parameters about the ink container such as the number of ink drops emitted, the print mode, the age of the ink container, print job assurance, and the like. However, there was no determination of which ink color was depleted first and how to compensate for this ink color depletion. Therefore, a further advantageous system, then, would be provided if a memory device would be employed that determined which ink/toner color was depleted first and how to compensate for this ink/toner color depletion.

It is apparent from the above that there exists a need in the art for a printing system that was capable of determining which ink/toner color was depleted first and to be able to compensate for that color depletion. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing an ink/toner cartridge compensation system for uneven ink/toner usage, comprising: an ink/toner cartridge including a plurality of ink/toner colors; a printer driver operatively connected to the cartridge; a memory device operatively connected to the printer driver for recording ink/toner usage of the cartridge; and a display device operatively connected to the printer driver to allow a user to determine which color was depleted first and to compensate for the uneven usage of that color.

In certain preferred embodiments, the system also includes a print head and a printer mechanism that are also operatively connected to the printer driver.

In another further preferred embodiment, the display device includes a color compensator that allows the user to determine what color was depleted first in previously installed ink/toner cartridge and allows the user to manually adjust the color compensation using a slider mechanism.

The preferred ink/toner cartridge compensation system, according to various embodiment of the present invention, offers the following advantages: lightness in weight; ease of assembly and repair; good stability; good durability; excellent ink/toner color depletion measurement characteristics; excellent ink/toner color compensation characteristics; and excellent economy. In fact, in many of the preferred embodiments, these factors of ink/toner color depletion measurement characteristics, ink/toner color compensation characteristics, and economy are optimized to an extent that is considerably higher than heretofore achieved in prior, known ink/toner container systems.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
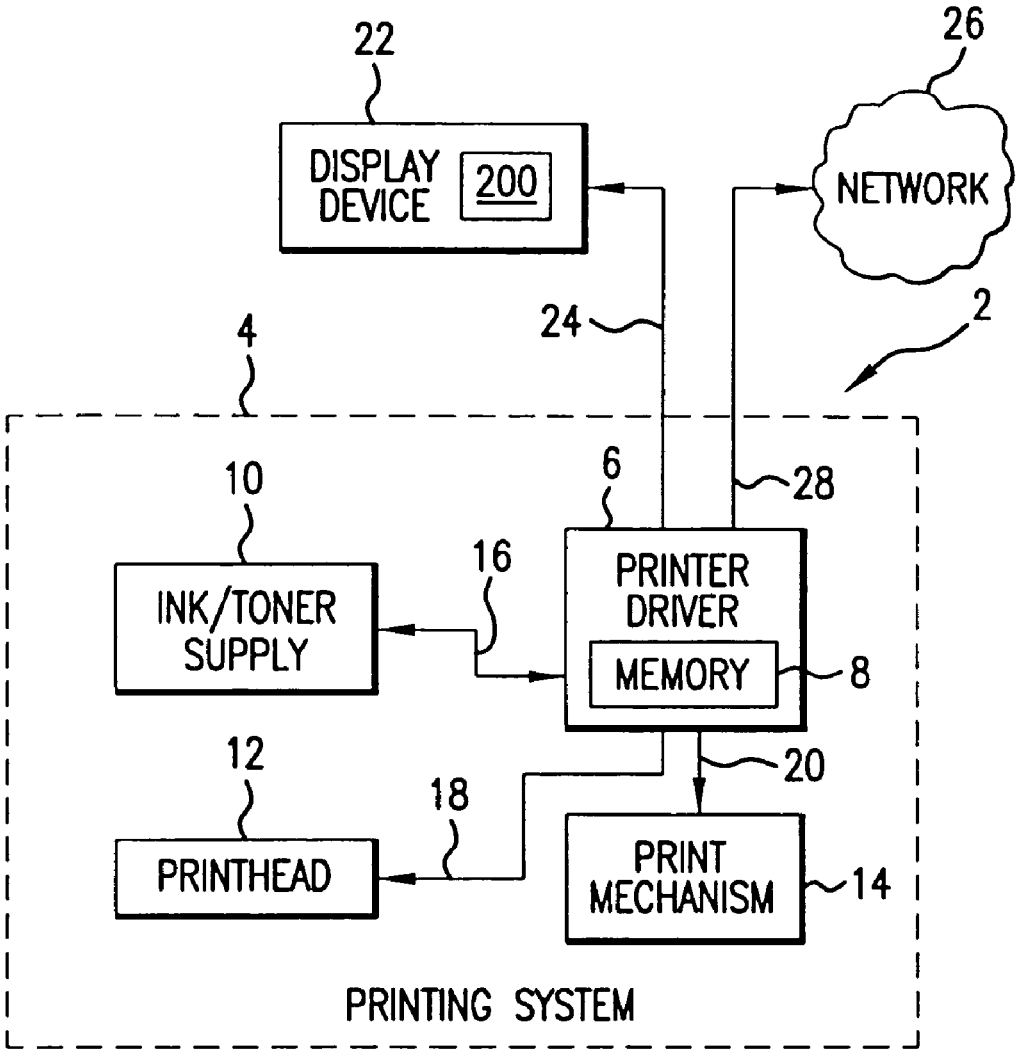
FIG. 1 is a block diagram of a printing system, according to one embodiment of the present invention.

With reference first to FIG. 1, there is illustrated one preferred embodiment for use of the concepts of this invention. FIG. 1 illustrates a block diagram of the printing system 2 of the present invention. Printing system 2 includes, in part, printing system 4, printer driver 6, printer driver memory 8, ink/toner supply 10, conventional print head 12, conventional print mechanism 14, electrical connections 16, 18, 20, 24, 28 a display device 22, and network 26.

Printer driver 6, typically, is a software routine that converts an application program's printing request into a language the printer understands. For example, printer driver 6 can control the relative movement of the carriage (not shown) in print head 12. Printer driver memory 8, preferably, is any suitable combination of volatile memory elements (e.g. random access memory (RAM)) and nonvolatile memory elements (e.g. read-only memory (ROM), Flash memory, hard disk, etc.) that is capable of storing ink/toner usage information related to the ink/toner supply 10. It is to be understood that printer driver memory 8 can be located remotely from printer driver 6 and accessed through network 26. Ink/toner supply 10, preferably, is any suitable ink/toner cartridge that is capable of containing a plurality of ink/toner colors such as cyan, magenta, yellow or the like. Electrical connections 16, 18, 20, 24, and 28 allow printer driver 6 to control the various components of the printing system 2 and display device 22. Display device 22, preferably, comprises the tools with which the device settings can be changed and through which the user can communicate commands to printer driver 6 and includes a color compensator 200 (FIG. 5) for determining which color was depleted first in the previously installed ink/toner cartridge and to manually compensate for uneven color usage. Color compensator 200, preferably, is located on display 22. Network 26 can be multiple sub-networks that are communicatively coupled to each other. Also, network 26 may include one or more local area networks (LANs) and one or more wide area networks (WANs) that comprise part of the Internet.

Figure 2:
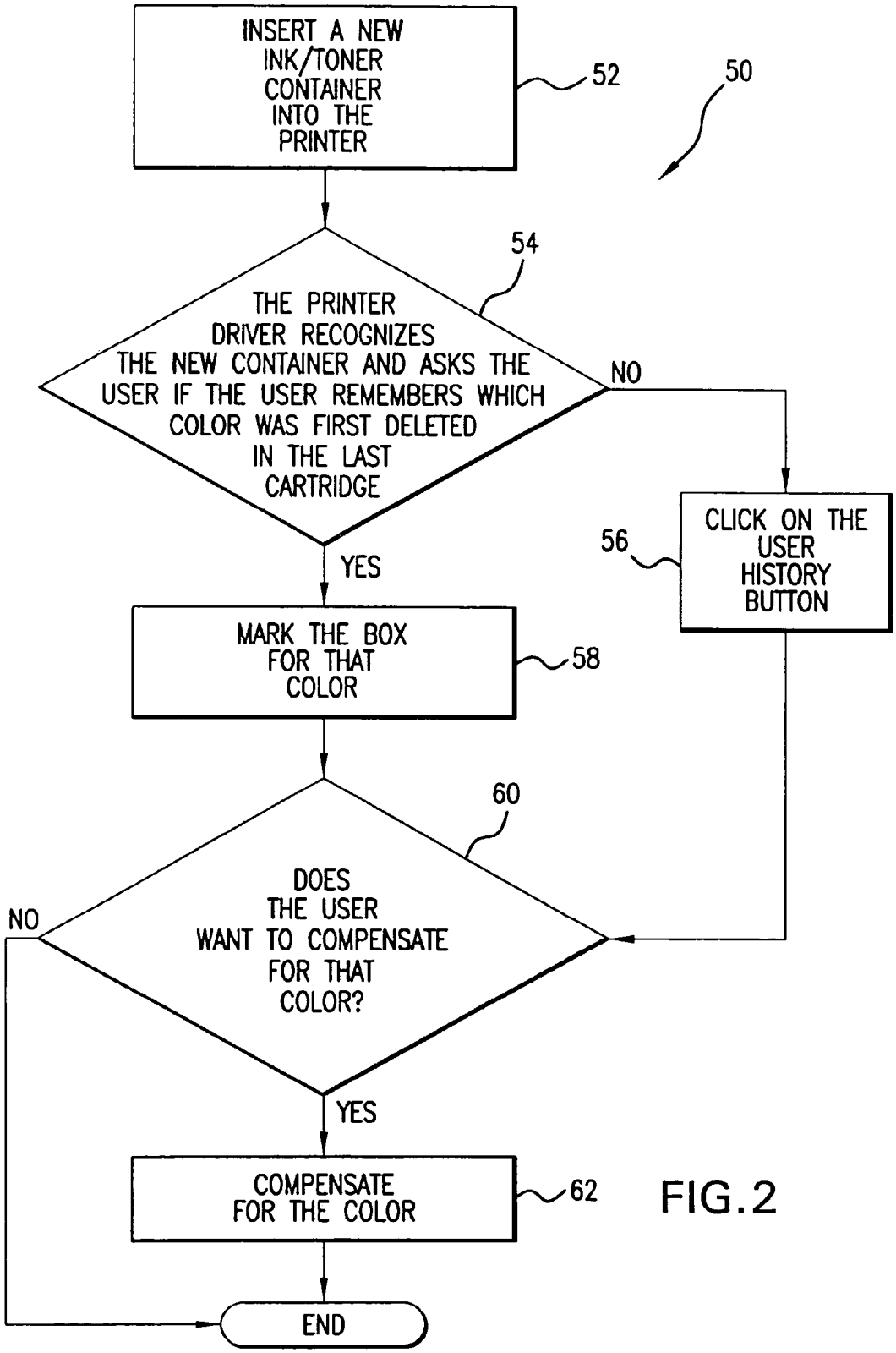
FIG. 2 is a flow diagram of the operation of the printing system of FIG. 1, according to another embodiment of the present invention.

FIG. 2 represents a flow diagram for the operation 50 of printing system 2 (FIG. 1) for use in compensating for uneven ink/toner color usage. Operation 50 includes the steps of: inserting a new ink/toner container into the printing system 4 (step 52); allowing printer driver 6 to recognize the new ink/toner container and requesting if the user remembers which color was first depleted in the previously installed cartridge (step 54); if the user is unable to determine which color was first depleted in the previously installed cartridge, the user can click on the user history button 206 (FIG. 5), as will be further discussed (step 56); if the user can determine which color was first depleted in the previously installed cartridge, the user can select the color in color box 202 (FIG. 5), as will be further discussed (step 58); the user can then determine if a color compensation is to be performed on that depleted color (step 60); and if the user desires to compensate for that color, a compensation is performed on that color (step 62). If user does not desire to compensate for that color, no compensation is performed on that color.

Figure 3:
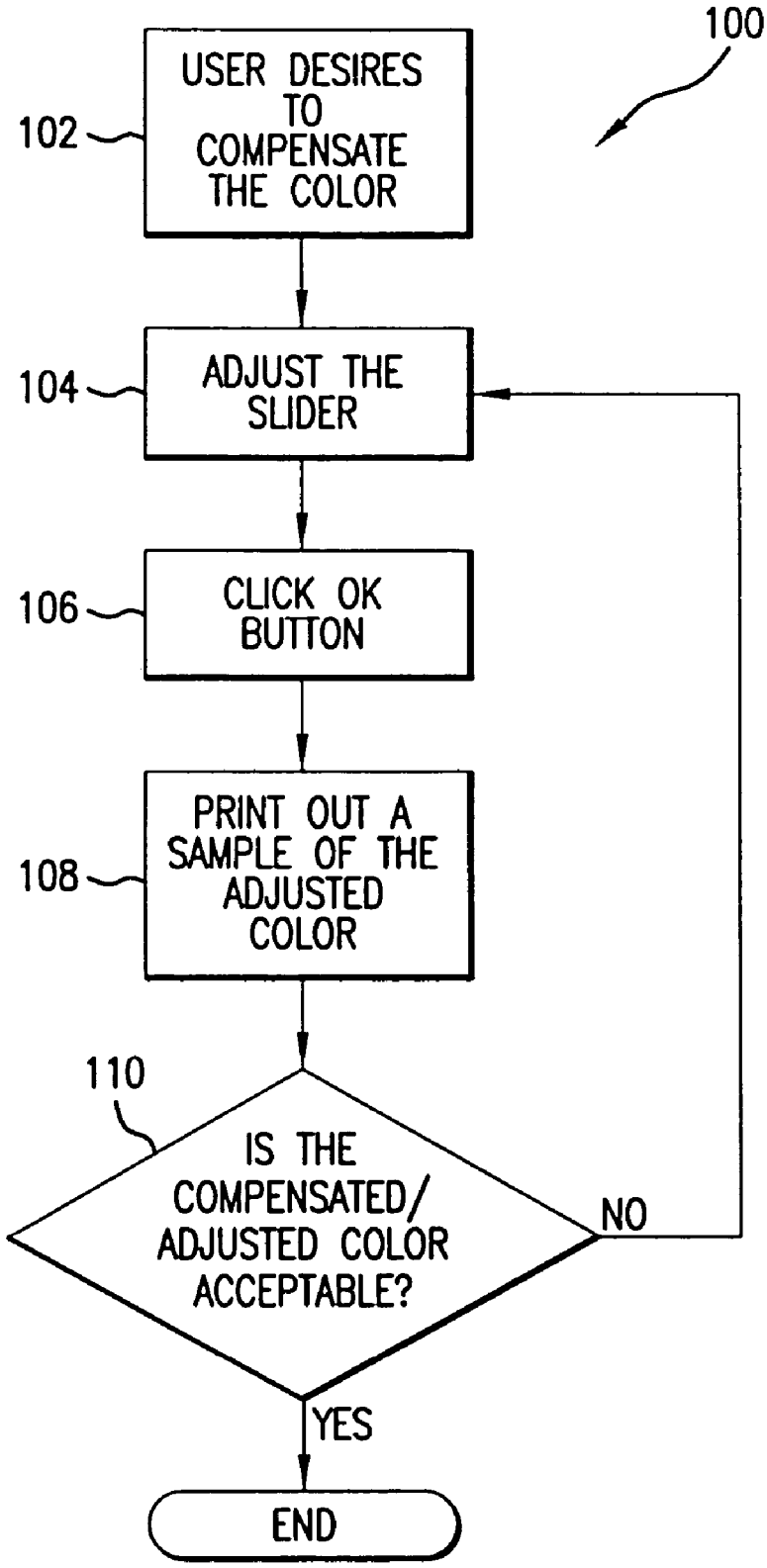
FIG. 3 is a flow diagram of the operation of the color compensating system, according to another embodiment of the present invention.

FIG. 3 represents a flow diagram of the operation of the color compensating method 100. Method 100 includes, among other things, the steps of: the user desires to compensate for the depleted color (step 102); the user adjusts the slider 208 (FIG. 5), as will be further discussed (step 104); the user clicks on the OK button 210 (FIG. 5), as will be discussed further (step 106); the user clicks on the print sample button 212 (FIG. 5) to print out a sample of the adjusted color (step 108); and the user determines if the compensated/adjusted color is acceptable (step 110). If the compensated/adjusted color is not acceptable, the user may have to adjust the slider, as discussed with respect to step 104. If the user is satisfied with the compensated/adjusted color, that compensated/adjusted color is then utilized in future printing.

Figure 4:
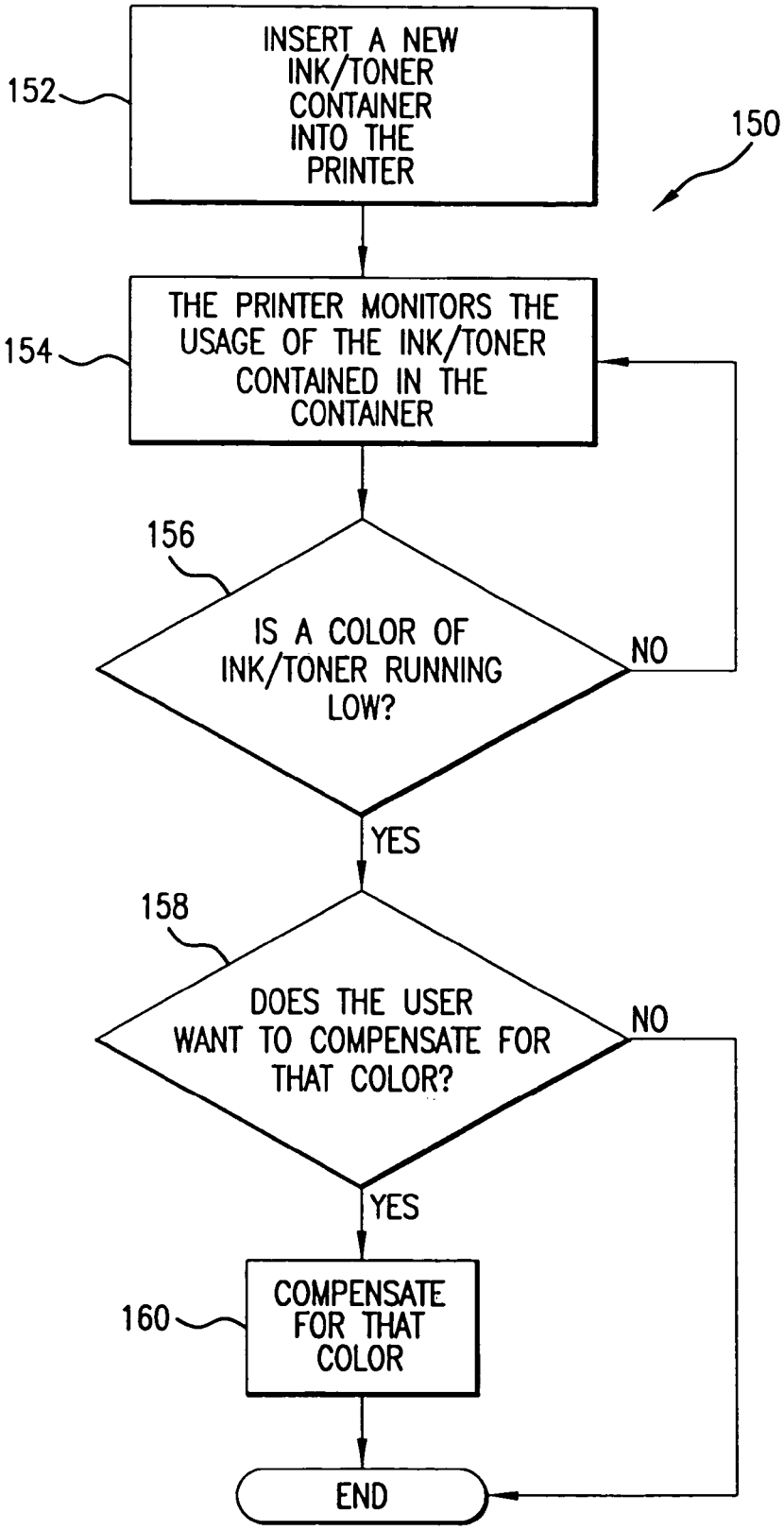
FIG. 4 is a flow diagram of another operation of the printing system of FIG. 1, according to another embodiment of present invention.

FIG. 4 represents a flow diagram of another method of operation 150 for printing system 2 (FIG. 1). Method 150 includes, among other things, the steps of: inserting a new ink/toner container/supply 10 into the printing system 4 (step 152); monitoring the usage of the ink/toner contained in the container by printer driver 6 and printer driver memory 8 (step 154); determining if a particular color of ink/toner is running low or is depleted (step 156); having the user determine if the user wants to compensate for the ink/toner color that is running low or is depleted (step 158); and if the user decides to compensate for the ink/toner color that is running low or is depleted, printing system 2 compensates for that color, as described above with respect to FIG. 3.

Figure 5:
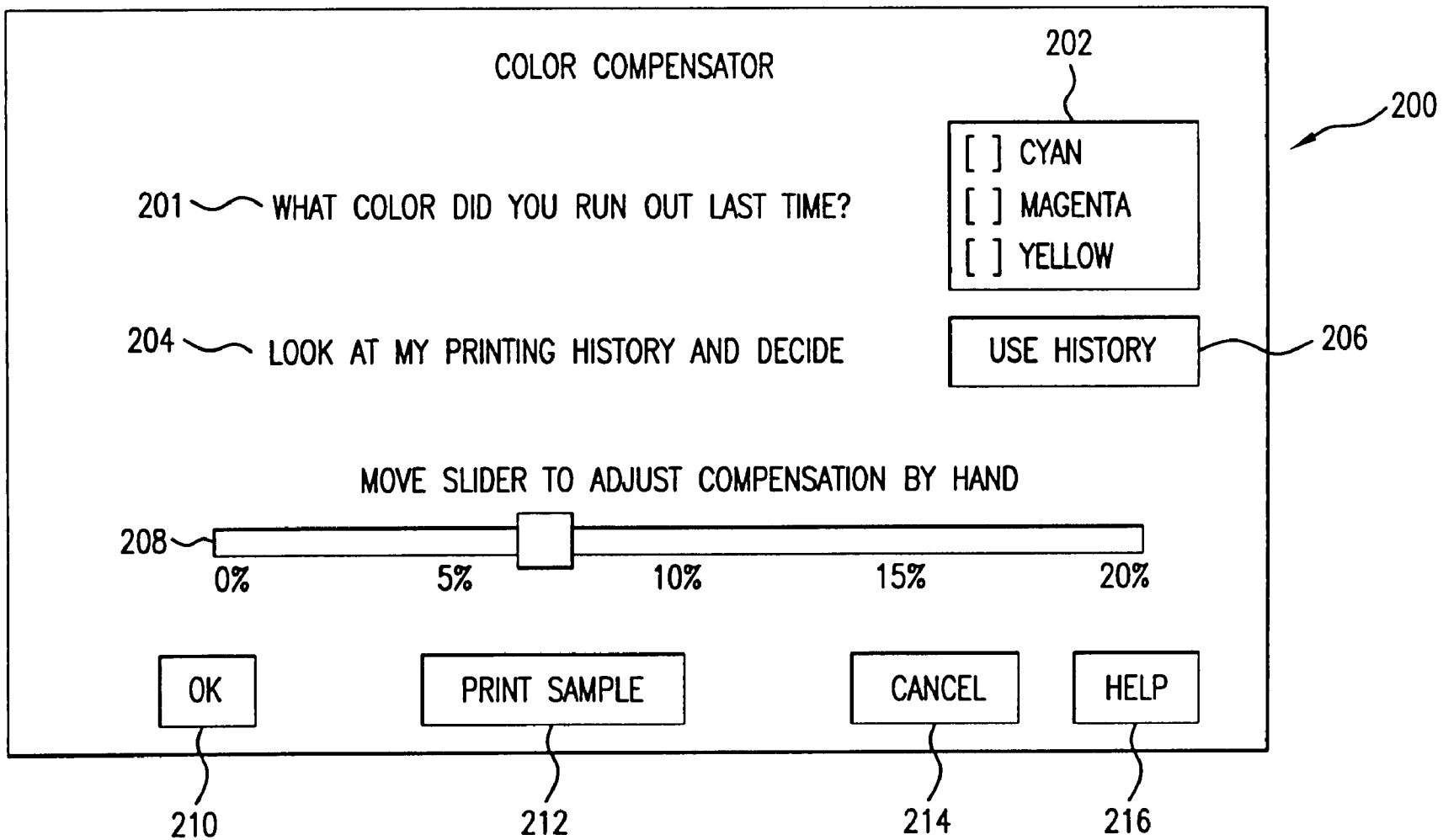
FIG. 5 is a schematic illustration of the color compensator, according to another embodiment of the present invention.

FIG. 5 is a schematic illustration of color compensator 200 located on display device 22 (FIG. 1). Color compensator 200 allows for user interaction to compensate for an ink/toner color that is running low or is depleted. Color compensator 200 includes, in part, first interaction line 201, color selections 202, second interaction line 204, use history button 206, slider/scale 208, OK button 210, print sample button 212, cancel button 214, and help button 216. First interaction line 201 along the color selections 202, as discussed above, are utilized by the user when the user knows which ink/toner color was depleted first in the previously installed cartridge. As discussed above, the user merely selects the color that was depleted, adjusts slider 208, clicks on the OK button 210, clicks on the print sample button 212, and views the sample in order to determine if the adjusted/compensated color is acceptable.

However, if the user is unable to determine which ink/toner color was depleted first in the previously installed cartridge, the user utilizes second interaction line 204 along with use history button 206 to allow printer driver 6 and printer driver memory 8 to determine which ink/toner color was depleted first in the previously installed cartridge. The printer driver 6 and printer driver memory 8 are then used to determine which ink/toner color was depleted first in the previously installed cartridge and this information is displayed in color selections 202. Thereafter, the user compensates/adjusts the depleted color, as discussed above. It is to be understood that ink/toner supply 10, print head 12, and printer mechanism 14 can be controlled by printer driver 6 and printer driver memory 8 in order to automatically compensate/adjust for the ink/toner color that was depleted or is running low. It is further to be understood that information regarding the ink/toner usage may be passed to a system administrator through network 26 for use in determining system usage.

Cancel button 214, preferably, can be used in order to cancel any work in progress currently being completed on color compensator 200. Help button 216, preferably, can be used in order to assist the user if the user encounters problems during the use of printing system 2. For example, help button 216 may allow the user to connect to a web site of the ink/toner cartridge manufacturer. In this manner, the user may then be provided guidance through the web site so that the user can properly use printing system 2.

It is to be understood that the flowchart of the FIGURE shows the architecture, functionality, and operation of one implementation of the present invention. If embodied in software, each block may represent a module, segment, or portion of code that comprises one or more executable instructions to implement the specified logical function(s). If embodied in hardware, each block may represent a circuit or a number of interconnected circuits to implement the specified logical function(s).

Also, the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Although the flowchart of the FIGURE shows a specific order of execution, the order of execution may differ from that which is depicted. For example, the order of execution of two or more blocks may be scrambled relative to the order shown. Also, two or more blocks shown in succession in the FIGURE may be executed concurrently or with partial concurrence. All such variations are within the scope of the present invention.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. An ink/toner cartridge compensation system for uneven ink/toner usage, comprising:

a memory device for recording which color has been depleted in a previously installed cartridge such that said previously installed cartridge includes a plurality of colors wherein one of the colors has been depleted;

a subsequent ink/toner cartridge including a plurality of ink/toner colors wherein the subsequent cartridge is inserted into the system;

a printer driver operatively connected to said subsequent cartridge and said memory device;

a display device operatively connected to said printer driver to allow a user to determine which one of the plurality of colors was depleted first in said previously installed cartridge and to compensate for an uneven usage of that color in said subsequent cartridge.

2. The system, as in claim 1, wherein said display device is further comprised of:

a first interaction line;

a plurality of color selections;

a second interaction line;

a use history button;

a slider/scale;

an OK button;

a print sample button;

a cancel button; and a help button.

3. The system, as in claim 1, wherein said system is further comprised of:

a print head operatively connected to said printer driver; and a print mechanism operatively connected to said printer driver.

4. A method for ink/toner cartridge compensation, comprising the steps of:

removing a previously installed ink/toner cartridge from a printing system wherein said previously installed cartridge includes a plurality of colors such that one of the colors has been depleted;

storing, in a printer memory, which one of the colors was depleted;

inserting a new ink/toner cartridge into said printing system;

allowing a printer driver to recognize said new ink/toner cartridge;

allowing said user to determine a cartridge history of said previously installed cartridge;

having a user determine if said user wants to compensate for said ink/toner color that is depleted; and if said user decides to compensate for said ink/toner color that is depleted, compensating for that color in said new cartridge.

5. The method, as in claim 4, wherein said compensating step is further comprised of the steps of:

compensating for the depleted color;

adjusting a slider;

clicking an OK button;

clicking on a print sample button to print out a sample of said adjusted color; and determining if said compensated/adjusted color is acceptable.

6. The method, as in claim 4, wherein said compensating step is further comprised of the steps of:

clicking a cancel button, if said user desires to cancel said compensating step.

7. The method, as in claim 4, wherein said compensating step is further comprised of the steps of:

clicking a help button, if said user needs assistance in completing said compensating step.

8. A system for ink/toner cartridge compensation, comprising:

a memory means for recording which color has been depleted in a previously installed cartridge such that said previously installed cartridge includes a plurality of colors wherein one of the colors has been depleted;

a subsequent ink/toner cartridge means having a plurality of ink/toner colors wherein the subsequent cartridge is inserted into the system;

a printer driver means operatively connected to said subsequent cartridge and said memory device; and a means for displaying information operatively connected to said printer driver to allow a user to determine which one of the plurality of colors was depleted first or is running low in said previously installed cartridge and to compensate for an uneven usage of that color in said subsequent cartridge.

9. A computer readable medium having instructions for a method for ink/toner cartridge compensation, comprising the steps of:

removing a previously installed ink/toner cartridge from a printing system wherein said previously installed cartridge includes a plurality of colors such that one of the colors has been depleted;

storing, in a printer memory, which one of the colors was depleted;

inserting a new ink/toner cartridge into said printing system;

allowing a printer driver to recognize said new ink/toner cartridge:

allowing said user to determine a cartridge history of said previously installed cartridge;

having said user determine if said user wants to compensate for said ink/toner color that is depleted; and if said user decides to compensate for said ink/toner color that is depleted, compensating for that color in said new cartridge.

10. The medium, as in claim 9, wherein said compensating step is further comprised of the steps of:

compensating for the depleted color;

adjusting a slider;

clicking an OK button;

clicking on a print sample button to print out a sample of said adjusted color; and determining if said compensated/adjusted color is acceptable.

11. The medium, as in claim 9, wherein said compensating step is further comprised of the steps of:

clicking a cancel button, if said user desires to cancel said compensating step.

12. The medium, as in claim 9, wherein said compensating step is further comprised of the steps of:

clicking a help button, if said user needs assistance in completing said compensating step.

* * * * *

UNITED STATES PATENT AND TRADEMARK OFFICE

CERTIFICATE OF CORRECTION

PATENT NO. : 7,029,088 B2
APPLICATION NO. : 10/681848
DATED : April 18, 2006
INVENTOR(S) : Charles V. Fernandez It is certified that error appears in the above-identified patent and that said Letters Patent is hereby corrected as shown below:

In column 5, line 44, in Claim 1, after “device;” insert -- and --.

In column 6, line 15, in Claim 4, delete “a” and insert -- said --, therefor.

In column 6, line 67, in Claim 9, delete “cartridge:” and insert -- cartridge; --, therefor.

Signed and Sealed this

Fourth Day of August, 2009

JOHN DOLL
*Acting Director of the United States Patent and Trademark Office*